United States Patent [19]

Brunet et al.

[11] 4,223,623

[45] Sep. 23, 1980

[54] HINGED FLOATING CAISSONS AND UNFOLDING DEVICES THEREFOR

[75] Inventors: Roger Brunet, La Seyne-sur-Mer; Gérard Marenco, Six-Fours-les-Plages, both of France

[73] Assignee: Constructions Navales et Industrielles de la Mediterranee, La Seyne-sur-Mer, France

[21] Appl. No.: 897,160

[22] Filed: Apr. 17, 1978

[30] Foreign Application Priority Data

Apr. 22, 1977 [FR] France ..... 77 12191

[51] Int. Cl.[2] ..... B63B 3/02

[52] U.S. Cl. ..... 114/77 R; 9/2 F; 14/27

[58] Field of Search ..... 14/69.5, 71.1, 71.3, 14/27, 2.6; 115/1 B; 414/537, 538; 9/11 R, 15, 16, 2 F, 2 S, 8 R; 160/188; 114/44, 46, 47, 49, 77 R, 263, 266, 267, 201 R; 244/137 R

[56] References Cited

U.S. PATENT DOCUMENTS

| | | | |
|---|---|---|---|
| 3,152,568 | 10/1964 | Mayer | 114/266 |
| 3,362,460 | 1/1968 | Ligh | 160/188 |
| 3,661,114 | 5/1972 | Wagner et al. | 115/1 B |
| 3,788,254 | 1/1974 | Sheil | 114/266 |
| 3,908,580 | 9/1975 | Kinzel et al. | 115/1 B |
| 4,039,163 | 8/1977 | Shorey | 244/137 R |

*Primary Examiner*—Sherman D. Basinger
*Attorney, Agent, or Firm*—Wenderoth, Lind & Ponack

[57] ABSTRACT

A hinged floating box caisson structure includes a central caisson, a pair of lateral caissons and a pair of end ballasts, these elements are adapted, when in a transport position, to be folded on one another. A system for straightening the end ballasts and for unfolding the lateral caissons is arranged to produce simultaneously a 180-degree rotation of the lateral caissons and the straightening of the end ballasts. One actuator is provided for controlling these simultaneous movements.

6 Claims, 9 Drawing Figures

HINGED FLOATING CAISSONS AND UNFOLDING DEVICES THEREFOR

BACKGROUND AND SUMMARY OF THE INVENTION

The present invention relates to articulated or hinged floating box caissons provided with means for unfolding or spreading the elements thereof from a transport position to an operative position.

It is the primary object of the present invention to provide a hinged box caisson and control structure therefor, the arrangement being such that the ratio of the overall width of the caisson in its transport position to the width in its operative position will be approximately 1:3.

A floating box caisson according to the instant invention comprises a central caisson and a pair of lateral caissons each associated with an end ballast, these elements being adapted, in the transport position, to be folded on one another. The floating caisson includes a system for straightening the ballasts and another system for unfolding the lateral caissons. Such systems are designed such that they are capable of rotating the lateral caissons through an angle of 180° and of simultaneously straightening the end ballasts, such movements being obtained by using a single actuator.

According to an essential feature characterizing this invention, the system for unfolding the lateral caissons comprises a cylinder, a rocker and a link assembly, and the system for straightening the ballasts comprises a constant-length rope system interconnecting a fixed point of the central caisson to a fixed point of the respective ballast. Operation of the cylinder simultaneously causes the unfolding of the lateral caissons and the straightening of the end ballasts.

According to a further feature characterizing this invention the constant length rope system includes means for taking up slack in the rope, notably when the component elements of the floating caisson are in their transport or folded position. These means may consist for example of a spring-urged arm pivoted at one end to a fixed point of the end ballast, the rope passing around the opposite or free end of the arm.

BRIEF DESCRIPTION OF THE DRAWINGS

Other features and advantages of this invention will appear as the following description proceeds with reference to the accompanying drawings, illustrating diagrammatically by way of example a typical embodiment of the invention, and wherein.

DETAILED DESCRIPTION OF THE INVENTION

Figure 1:
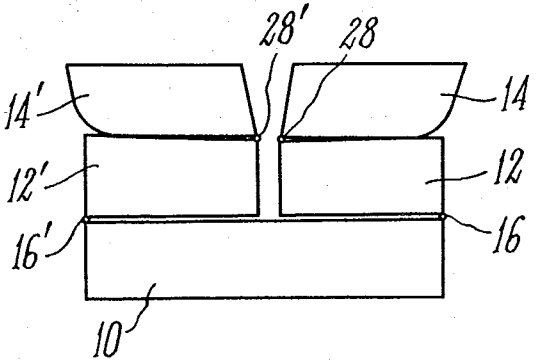
FIG. 1 is a side elevational view illustrating diagrammatically a hinged floating box caisson in its folded or transport position.
Figure 2:
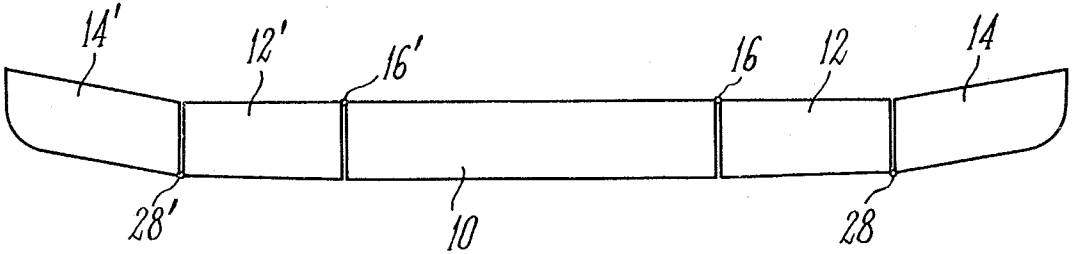
FIG. 2 is a side elevational view of the caisson of FIG. 1, but shown in its operative position.

As clearly shown in FIGS. 1 and 2 of the drawing, a hinged floating box caisson according to the present invention comprises a central caisson 10, a pair of lateral caissons 12, 12' disposed on either side of the central caisson, and a pair of end ballasts 14, 14' each disposed at the outer ends of the lateral caissons, respectively. As already mentioned in the foregoing, this hinged floating caisson comprises means for unfolding its component elements from the transport position shown in FIG. 1 to the operative position shown in FIG. 2. By way of non-limiting example, the invention may provide a hinged floating caisson having a width of 3.5 meters in the transport position and a width of 9.2 meters in the operative position.

The means for unfolding this caisson are so arranged that the passage from the transport position to the operative position is obtained by rotating simultaneously the lateral caissons 12, 12' through an angle of 180° with respect to the central caisson, and subsequently straightening the end ballasts 14, 14'.

Figure 3:
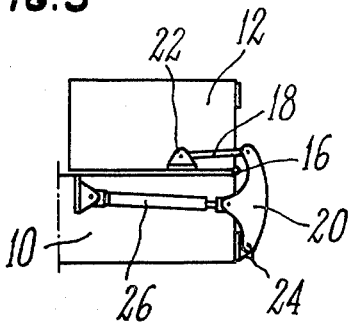
FIGS. 3 to 5 are side elevational views showing diagrammatically the means contemplated for unfolding the lateral caissons during the successive steps of an unfolding operation.
Figure 4:
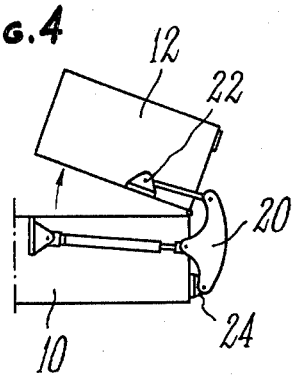
Figure 5:
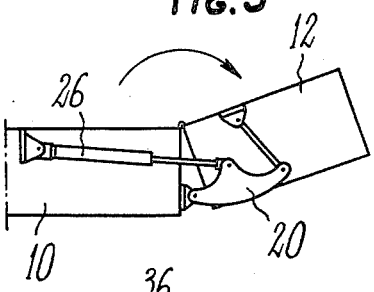

Reference will first be made to FIGS. 3 to 5 for describing the means contemplated for unfolding the lateral caissons 12, 12'.

Each lateral caisson 12, 12' (FIG. 3) is hingedly mounted by means of a corresponding hinge shaft 16' to the corresponding upper lateral edge of the central caisson 10. A rocker and link assembly 20, 18 is pivoted on the one hand by a shaft 22 to the lateral caisson 12 and on the other hand by a shaft 24 to the central caisson 10. The movement of this assembly 18, 20 is controlled by means of a hydraulic cylinder 26 pivoted to a pin carried by the central caisson 10.

Now reference will be made to FIGS. 6 to 9 to describe the means provided for simultaneously unfolding the lateral caissons and straightening the end ballasts 14, 14'. These means are so designed that they can be actuated by cylinders 26 alone, without resorting to any subsidiary source of power.

These means each comprise essentially a rope 30 attached at one end to a fixed point 32 of the central caisson 10 and at an opposite end to another fixed point 34 of the respective end ballast 14. This rope has a fixed length set upon assembling the elements, whereby during the unfolding of the lateral caisson 12 to which the end ballast 14 is pivoted or hingedly mounted at 28 the ballast 14 is automatically straightened and held in its unfolded or spread position. This rope 30 is guided during the unfolding operation by passing over a pulley 40 secured to one corner of the lateral caisson 12.

Means are also provided for taking up any slack developing in the rope, notably when the component elements of the floating hinged caisson structure are folded in their transport position. In the embodiment illustrated, these means comprise a mechanism including an arm 36 pivoted at one end thereof to the ballast 14 and urged by spring means 38. This arm 36 is shaped to facilitate the straightening of the end ballast (the distance between the rope and the hinge axis 28 of the ballast being increased, thus reducing the reaction torque and therefore the traction effort exerted in the rope).

The hinged box caisson according to this invention operates as follows.

Figure 6:
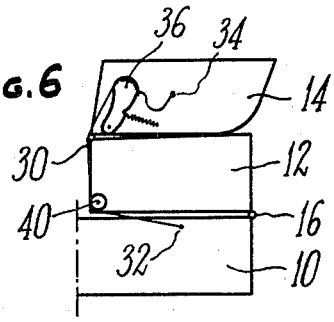
FIGS. 6 to 9 illustrate diagrammatically the means provided for straightening the end ballasts during the successive steps of the straightening operation.

The component elements 10, 12, 12', 14 and 14' of this hinged floating caisson structure are normally folded as shown in FIG. 6, any slack of the constant-length rope 30 being taken up permanently by the arm 36 urged by spring 38.

Figure 7:
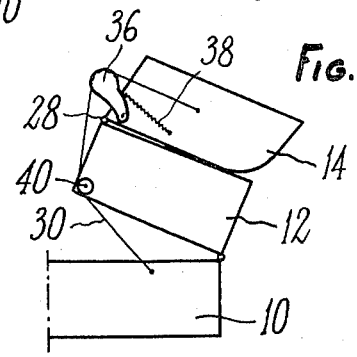
Figure 8:
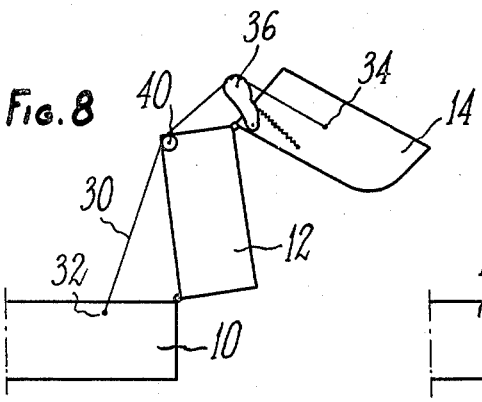
Figure 9:
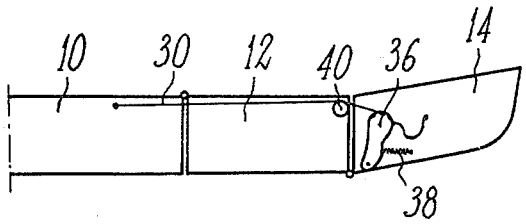

As already explained in the foregoing, each lateral caisson begins its unfolding movement and since the distance between the anchorage points 32, 34 of rope 30 increases, the arm 36 pivots in the counter-clockwise direction until it reaches a mechanical abutment position (FIG. 7).

As the unfolding movement of lateral caisson 12 continues (FIG. 8), the distance between the anchorage points 32 and 34 of rope 30 tends to increase and when the arm 36 is stopped mechanically, the rope 30 is tension-stressed and in turn rotates the end ballast 14 in the counter-clockwise direction. During this movement the rope 30 is guided by pulley 40.

At the end of the unfolding movement of the lateral caisson (FIG. 9), the constant-length rope 30 has straightened the ballast completely, thus completing the unfolding of the floating caisson structure to its operative position.

Of course, it will readily occur to those conversant with the art that this invention should not be construed as being limited by the specific embodiment described and illustrated herein, since many modifications and changes may be brought thereto without departing from the basic principles of the invention, as set forth in the appended claims.

What is claimed as new is:

1. A hinged floating box caisson structure comprising:

a central caisson;

a pair of lateral caissons hingedly connected to opposite ends of said central caisson by means of respective first pivots such that said lateral caissons are foldable about said first pivots with respect to said central caisson between an operative position, whereat said lateral caissons extend laterally of said opposite ends of said central caisson, and a transport position, whereat said lateral caissons are folded on top of said central caisson;

a pair of end ballasts hingedly connected to opposite free ends of said lateral caissons by means of respective second pivots such that said end ballasts are foldable about said second pivots with respect to respective said lateral caissons between an operative position, whereat said end ballasts extend substantially laterally of said respective lateral caissons when said lateral caissons are in said operative position thereof, and a transport position, whereat said end ballasts are folded on top of said respective lateral caissons when said lateral caissons are in said transport position thereof; and each said end of said central caisson and the respective said lateral caisson and said end ballast having associated therewith means for moving said lateral caisson from said transport position thereof to said operative position thereof and for simultaneously moving said end ballast from said transport position thereat to said operative position thereof, each said moving means comprising a rocker and link assembly pivotally connected to said central caisson and said respective lateral caisson, cylinder means connected to said central caisson and said rocker and link assembly for moving said rocker and link assembly and causing said lateral caisson to rotate about said first pivot through an angle of 180° from said transport position thereof to said operative position thereof, and a constant length rope connected at a first end thereof to a first fixed point on said end ballast and at a second end thereof to a second fixed point on said central caisson, whereby when said cylinder means is operated to rotate said lateral caisson about said first pivot, said rope extending between said first and second points is tensioned to cause said end ballast to rotate about said second pivot from said transport position thereof to said operative position thereof.

2. A structure as claimed in claim 1, wherein each said moving means further comprises means for taking up slack in said rope when said lateral caisson and said end ballast are in said transport positions thereof.

3. A structure as claimed in claim 1, wherein said moving means further comprises pulley means, mounted on said lateral caisson at said free end thereof, for guiding said rope during movement of said lateral caisson and said end ballast to said operative positions thereof.

4. A structure as claimed in claim 1, wherein said central and lateral caissons and said end ballasts are dimensioned such that the width of the structure when in the operative unfolded condition is approximately three times the width of the structure in the folded transport condition thereof.

5. A hinged floating box caisson structure comprising:

a central caisson;

a pair of lateral caissons hingedly connected to opposite ends of said central caisson by means of respective first pivots such that said lateral caissons are foldable about said first pivots with respect to said central caisson between an operative position, whereat said lateral caissons extend laterally of said opposite ends of said central caisson, and a transport position, whereat said lateral caissons are folded on top of said central caisson;

a pair of end ballasts hingedly connected to opposite free ends of said lateral caissons by means of respective second pivots such that said end ballasts are foldable about said second pivots with respect to respective said lateral caissons between an operative position, whereat said end ballasts extend substantially laterally of said respective lateral caissons when said lateral caissons are in said operative position thereof, and a transport position, whereat said end ballasts are folded on top of said respective lateral caissons when said lateral caissons are in said transport position thereof; and each said end of said central caisson and the respective said lateral caisson and said end ballast having associated therewith means for moving said lateral cassion from said transport position thereof to said operative position thereof and for simultaneously moving said end ballast from said transport position thereof to said operative position thereof, said moving means comprising a rocker and link assembly pivotally connected to said central caisson and said respective lateral caisson, cylinder means connected to said central caisson and said rocker and link assembly for moving said rocker and link assembly and causing said lateral caisson to rotate about said first pivot through an angle of 180° from said transport position thereof to said operative position thereof, a constant length rope connected at a first end thereof to a first fixed point on said end ballast and at a second end thereof to a second fixed point on said central caisson, whereby when said cylinder means is operated to rotate said lateral caisson about said first pivot, said rope extending between said first and second fixed points is tensioned to cause said end ballast to rotate about said second pivot from said transport position thereof to said operative position thereof, and means for taking up slack in said rope when said lateral caisson and said end ballast are in said transport positions thereof, said slack taking up means comprising an arm pivoted at a first end thereof about a third pivot to said end ballast, said rope passing around a second end of said arm, and spring means biasing said arm about said third pivot.

6. A structure as claimed in claim 5, wherein said arm has a configuration such that, during rotation of said end ballast about said second pivot from said transport position thereof to said operative position thereof, said arm moves said rope further from said second pivot and imparts a traction stress to said rope.

* * * * *